US009010656B2

(12) United States Patent
Cowin

(10) Patent No.: US 9,010,656 B2
(45) Date of Patent: Apr. 21, 2015

(54) HYDRANT FLUSHING DEVICE

(71) Applicant: Bob Cowin, Ottawa (CA)

(72) Inventor: Bob Cowin, Ottawa (CA)

( * ) Notice: Subject to any disclaimer, the term of this patent is extended or adjusted under 35 U.S.C. 154(b) by 0 days.

(21) Appl. No.: 13/951,714

(22) Filed: Jul. 26, 2013

(65) Prior Publication Data

US 2014/0026967 A1 Jan. 30, 2014

Related U.S. Application Data

(60) Provisional application No. 61/676,965, filed on Jul. 29, 2012.

(51) Int. Cl.

| | |
|---|---|
| ***A62C 5/02*** | (2006.01) |
| ***E03B 7/09*** | (2006.01) |
| ***E03B 9/18*** | (2006.01) |

(52) U.S. Cl.

CPC .... *E03B 7/09* (2013.01); *E03B 9/18* (2013.01)

(58) Field of Classification Search

CPC ..... E03B 9/02; B01D 29/0018
USPC ..... 239/462, 542, 8; 137/15.04, 15.03; 210/232, 499
See application file for complete search history.

(56) References Cited

U.S. PATENT DOCUMENTS

| | | | | |
|---|---|---|---|---|
| 577,362 | A | 2/1897 | Ettlinger | |
| 3,429,125 | A | 2/1969 | Shotton | |
| 4,047,668 | A * | 9/1977 | DeWeese et al. | 239/500 |
| 6,056,211 | A * | 5/2000 | DiLoreto | 239/288 |
| 6,116,525 | A | 9/2000 | Grimes | |
| 6,117,316 | A | 9/2000 | Burton | |
| 6,227,463 | B1 * | 5/2001 | Porter | 239/310 |
| 6,294,096 | B1 | 9/2001 | Pate | |
| 6,820,635 | B1 | 11/2004 | McKeague | |
| 6,948,512 | B2 | 9/2005 | McKeague | |
| 7,458,532 | B2 | 12/2008 | Sloan | |
| 7,473,359 | B1 * | 1/2009 | Barrett, II | 210/232 |
| 7,748,650 | B1 | 7/2010 | Sloan | |
| 2006/0186225 | A1 | 8/2006 | Bartholmey et al. | |
| 2006/0231642 | A1 | 10/2006 | Matthews | |
| 2007/0138073 | A1 | 6/2007 | Matthews | |
| 2011/0278236 | A1 | 11/2011 | Matthews | |

* cited by examiner

*Primary Examiner* — Dinh Q Nguyen
(74) *Attorney, Agent, or Firm* — LifeCycle IP Management Inc.

(57) ABSTRACT

A water hydrant flushing device is disclosed. The device handles a flow of water from a water hydrant as it is being flushed, and allows the flushing to take place in a safer manner without destroying surrounding landscaping or other objects. The device comprises a chute that is open on both ends, and an opening on one end that is removably connected to a diffuser by means of a securing mechanism.

13 Claims, 3 Drawing Sheets

HYDRANT FLUSHING DEVICE

BACKGROUND OF THE INVENTION

State and municipal water departments flush water mains and water hydrants routinely as part of a regular maintenance program or when commissioning new construction, for example in a new subdivision, as water pressure and pipes are being tested and prepared for use. Flushing involves actuating hydrant valves to "full open" position so that maximum water flow will be allowed in order to achieve maximum efficiency of the maintenance or commissioning process.

Water hydrants are typically located along street curbs in areas where access to the hydrant could become necessary (e.g. for emergency use by fire departments), largely in residential or commercial neighbourhoods, although they can be mounted in various other locations. The hydrants are constructed to generally produce a high volume of water discharge, with sufficient pressure and kinetic energy to exert a potentially damaging force upon any object which might come into its path. Further, water flow from the hydrant valve will exit in a fixed direction from the hydrant, without any ability to control the direction of discharge. As a result, flushing water hydrants can pose a serious safety issue to any nearby objects and passing pedestrian or vehicular traffic, particularly in residential neighbourhoods. To minimize such risk, water hydrant flushing will involve blocking traffic and the presence of personnel to protect the immediate vicinity of the hydrant.

In addition to safety concerns, the high pressure flow from a full open hydrant can cause environmental damage to landscaping in the output path of the flow. The result can be unsightly and costly landscaping repairs, washout erosion damage, and sediment build up in the water system (i.e. pollution).

SUMMARY OF THE INVENTION

The present invention provides a device that overcomes the inconvenience surrounding hydrant flushing. Further, the invention provides a portable device that allows flushing to take place in a safe manner without damaging the surrounding environment.

In one embodiment, the present invention provides a water hydrant flushing device having a chute. The chute is open on both ends, and comprises an opening on one end that is removably connected to a diffuser. The chute may be constructed of fabric, or any durable and flexible material.

DETAILED DESCRIPTION OF THE INVENTION

Figure 1:
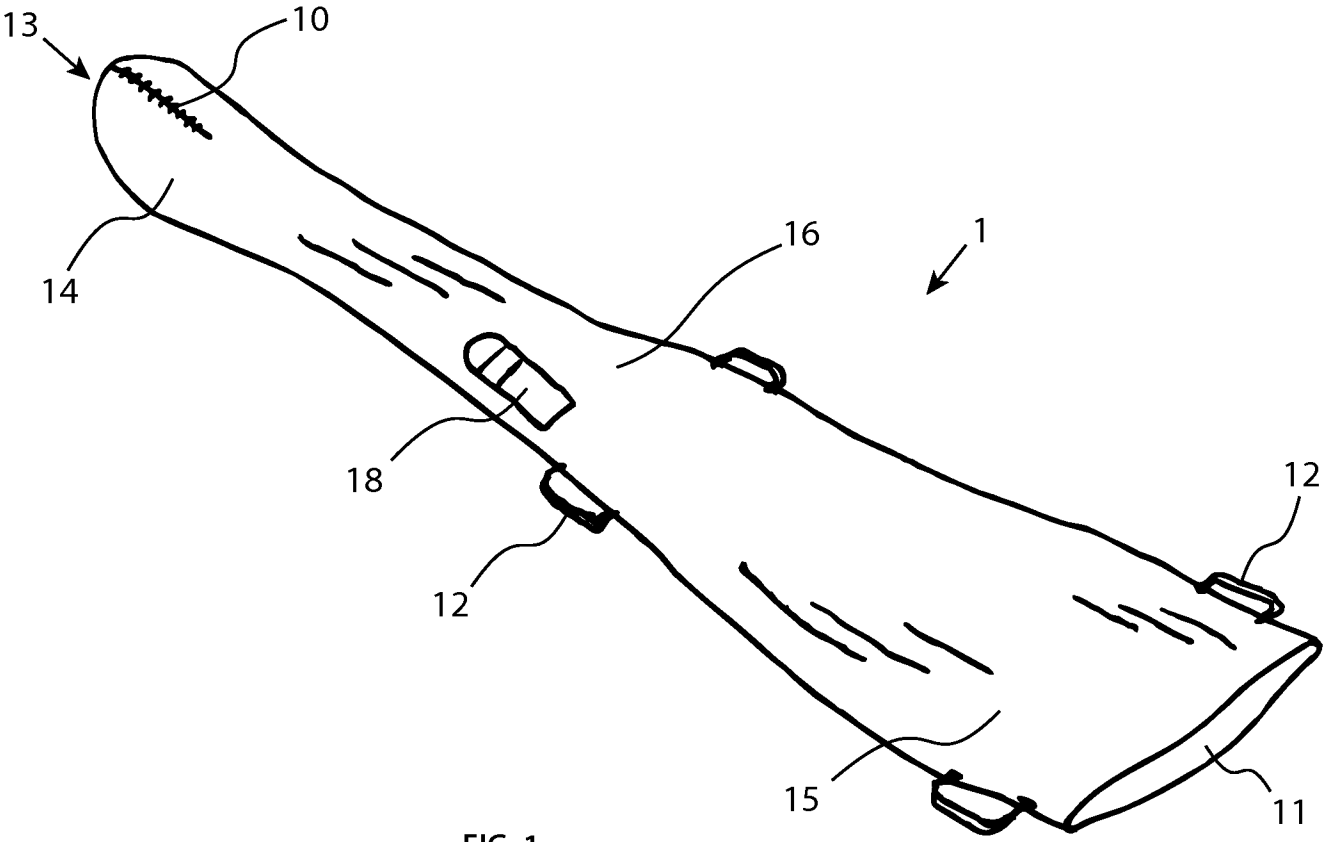
FIG. 1 is a perspective view of the water hydrant flushing device, in accordance with one embodiment of the present invention.

The following description is presented to enable any person skilled in the art to make and use the invention, and is provided in the context of particular applications of the invention. Various modifications to the disclosed embodiments will be readily apparent to those skilled in the art, and the general principles defined herein may be applied to other embodiments and applications without departing from the scope of the present invention. Reference to various embodiments and examples does not limit the scope of the invention, which is limited only by the scope of the claims attached hereto. Additionally, any examples set forth in this specification are not intended to be limiting and merely set forth some of the many possible embodiments for the claimed invention.

The present invention relates to a device for flushing water hydrants. Specifically, the invention comprises a water hydrant flushing device that lessens the force of water flowing out of an opened water hydrant, and provides a convenient and safer means to control direction of the water flow.

Accordingly, in one aspect, the present invention provides a water hydrant flushing device comprising: a first end comprising a first opening; a second end comprising a second opening; and a chute, wherein the first end is removably attachable to a water hydrant diffuser. The water hydrant flushing device may comprise a flexible material selected from the group consisting of nylon, PVC, canvas, latex or natural rubber, Gore-Tex™, vinyl, fluoropolymer fabrics, or other suitable synthetic materials and/or fabrics. The water hydrant flushing device may comprise a material that is substantially water-proof. The chute is preferably of a longitudinal dimension sufficiently large to provide dissipation of kinetic energy in water discharged from a water hydrant. The water hydrant flushing device may comprise at least one aperture proximate to the first end. The first end may comprise a securing means. The securing means may be selected from the group consisting of: a zipper, Velcro™ strips, snaps, cleats, laces, ties and hooks, and may also comprise at least one handle disposed on the chute. The water hydrant flushing device may comprise at least one aperture at the first opening. The at least one aperture may allow air flow into the chute through said at least one aperture upon water flowing from the first end towards the second end of the chute. The at least one aperture may comprise a hardware component selected from the group consisting of: a tube, a pipe, a cone, an elbow and a valve. The water hydrant flushing device may comprise a pocket disposed on the chute, wherein the pocket accommodates at least one de-chlorination puck. The pocket may comprise a transparent window.

In another aspect, the present invention provides a method for flushing a water hydrant, said method comprising the steps of: attaching the water hydrant flushing device described herein to a water hydrant diffuser; and actuating a water flow valve on the water hydrant.

Referring to FIG. 1, the water hydrant flushing device 1 comprises an elongated tube or chute 16 that is open on both ends, and tapers to an opening 13 at a first end 14, and is fully open with an opening 11 at a second end 15.

The chute 16 may be provided in different cross-sectional shapes, such as square, rectangular, circular, elliptical, or complex geometric shape. The cross-sectional area of chute 16 may be generally constant from after a tapered first end 14 until the second end 15, or may be increasing such that opening 11 provides the largest cross-sectional area at any point along the length of chute 16. Varying the cross-sectional area and/or cross-sectional shape of the chute 16, particularly at the first end 14, will allow it to accommodate attachment to different models and shapes of diffusers, as later discussed in further detail with reference FIG. 2. The chute 16 comprises a flexible material or fabric that is preferably generally waterproof. The chute 16 may also provide one or more layers of flexible material to provide reinforcement and durability to the invention. Said additional layers may be selectively positioned where the greatest force is to be expected from flowing water (e.g. near first end 14). Examples of suitable materials include nylon fabric, PVC, canvas, latex or natural rubber, Gore-Tex™, vinyl, fluoropolymer fabrics, or other suitable synthetic materials and/or fabrics. Chute 16 may be provided in different lengths, depending on the application and operator requirements (e.g. municipal water supply pressure, and therefore water pressure at hydrant spout 22), but in a length at least sufficient to provide dissipation of the force or kinetic energy in water discharged from a water hydrant. Chute 16 is preferably 3' to 48' in length, more preferably 6' to 36' in length, and most preferably 12' to 24' in length.

Figure 2:
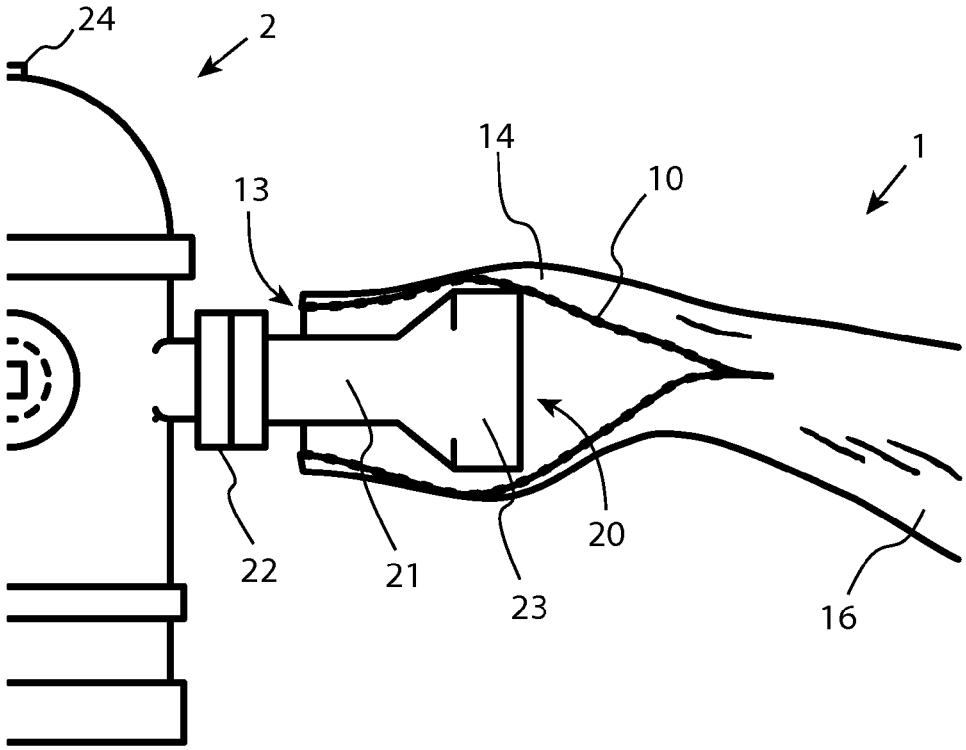
FIG. 2 is an exemplary side view of the water hydrant flushing device showing attachment to a water hydrant diffuser, in accordance with one embodiment of the invention.

Referring to FIG. 2, the first end 14 is dimensioned to fit around both a narrow portion 21 and a wide portion 23 of a diffuser 20, which is attached to a water hydrant 2 at hydrant spout 22. Diffusers are generally conical-shaped attachments that couple directly to the hydrant spout 22. First end 14 provides a securing means 10 such that the first end 14 is removably attached to diffuser 20. Advantageously, the present invention is sufficiently flexible to allow it to work in conjunction with a wide array of diffuser models and designs commercially available on the market. Advantageously, the present invention does not block hydrant valve 24 on the water hydrant 2.

As shown in FIG. 2, the securing means 10 is preferably provided by way of a zipper, but may comprise other removable securing means (not shown), such as Velcro™ strips, snaps, cleats, laces, hooks, ties, etc. Preferably, opening 13 is dimensioned to provide a snug fit with narrow portion 21 when securing means 10 is used to attach first end 14 to diffuser 20. Preferably, the chute 16 is provided with a variable cross-sectional area and/or cross-sectional shape at or proximate to first end 14 to accommodate different diffuser shapes. Optionally, the first end 14 of the water hydrant flushing device 1 may include one or more apertures (not shown) at or proximate to first end 14 to accommodate different diffuser designs, and/or protrusions or projections from the diffuser, such as, for example, a pressure gauge, a shut-off valve, a handle, etc. (not shown).

When the present invention is used in conjunction with water hydrant 2, hydrant valve 24 is actuated, water flows out hydrant spout 22, through and out diffuser 20, into first end 14, through chute 16 and out opening 11 at second end 15. Second end 15 is positioned by an operator such that chute 16 is disposed in a direction to provide the least disruption to the environment by the exiting water flow. Optionally, the water hydrant flushing device 1 may comprise one or more pulls or handles 12 to provide further control over the direction of the chute, and therefore direction of water flow. Specifically, handles 12 may be provided at various points the length of and on either side of the chute 16 so an operator may manually redirect the water flow, or stake the chute 16 in place so it will not move while in use. Advantageously, handles 12 provide the ability to reposition the chute 16 while in operation.

The water hydrant flushing device 1 dissipates the force or kinetic energy in the water discharged from the water hydrant 2, and allows it to be directed; thereby eliminating damage to property and the need to clean up or reinstate said property. The device also significantly reduces the noise generated during water hydrant flushing, and makes it far less of a distraction to the public and to motorists.

Some diffuser models allow in-situ de-chlorination of water, while other diffuser models do not. The present invention optionally comprises a pocket 18, disposed on chute 16. Pocket 18 accommodates one or more de-chlorination pucks (not shown), and thereby allows de-chlorination of the water flow while flushing a water hydrant 2. Pocket 18 preferably comprises a generally transparent window (not shown) to observe dissolution of the de-chlorination pucks in order to determine replacement timing.

Figure 3:
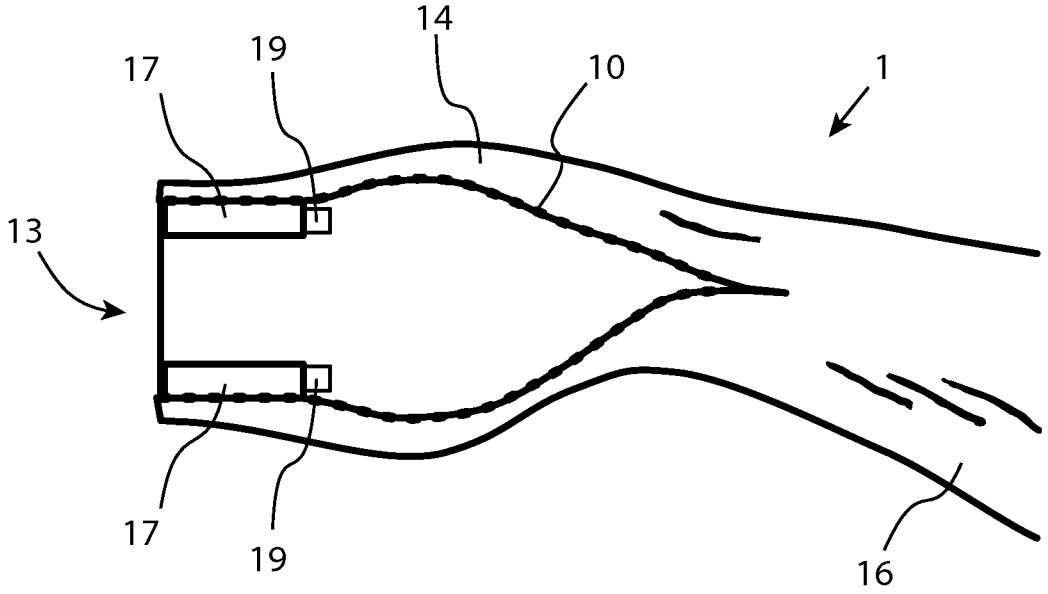
FIG. 3 is an exemplary side view of the water hydrant flushing device showing optional features, in accordance with one embodiment of the invention.

Referring to FIG. 3, water hydrant flushing device 1 optionally provides a fixed or variable aperture by way of a mechanism to allow air flow into the chute 16 at or around opening 13. As shown, the air flow mechanism preferably is provided by one or more air tubes 19 securely attached at first end 14. The attachment means 17 may comprise fabric covers that fit securely around tubes 19 (as shown), or may comprise other secure attachment means such as rivets, hooks, cleats, ties, etc. Preferably, tubes 19 are attached such that are generally disposed parallel to the direction of water flow. Suitable materials for tubes 19 include PVC, ABS or other material sufficiently rigid to withstand breakage or collapse when opening 13 is secured around a diffuser 20 by securing means 10. Tubes 19 are hollow and open at each end, preferably 3" to 36" in length, and more preferably 6" to 24" in length. Tubes 19 are preferably 0.25" to 4" in diameter, and more preferably 0.5" to 2" in diameter. Tubes 19 function to allow air to enter chute 16 when hydrant valve 24 is actuated.

Water flow out of spout 22 and into first end 14 acts to entrain air through tubes 19. Surprisingly, the entrainment of air though air tubes 19 acts to prevent collapse of chute 16 around the water flow from suction caused by the flow of water itself. As will be readily understood by a person skilled in the art, the shape of the air flow mechanism can vary in shape and size (e.g. it can be shaped as a pipe, a cone, an elbow, etc.) and may be provided by other rigid and/or adjustable hardware (e.g. a pipe comprising an adjustable valve) provided that the mechanism is sufficiently strong to withstand collapse from suction forces arising from water flow out of spout 22 and any constriction forces from securing means 10 at opening 13, and provided that the mechanism allows a sufficiently large air flow to assist in preventing collapse of chute 16.

Accordingly, the present invention provides a safer means to dissipate the kinetic energy of a flow of water from an open water hydrant in a controlled, directional manner, and in convenient conjunction with existing diffusers on the market. Further, the invention allows the operator to control flow with a gate valve, take pitot readings for flushing, or Fire Flow Testing, and optionally de-chlorinate drinking water as per local regulations, all in conjunction with different diffuser models.

I claim:

1. A water hydrant flushing device, wherein the device comprises:

a chute having a first end and a second end, wherein the first end comprises a first opening and the second end comprises a second opening; and at least one aperture proximate to the first end, wherein the first end is removably attachable by the first opening fitting over a water hydrant diffuser, wherein said chute is substantially water-proof and flexible, and wherein the at least one aperture allows entrainment of an air flow into the chute through the at least one aperture as water flows out of the water hydrant diffuser into the first end and out of the second opening.

2. The water hydrant flushing device of claim 1, wherein the device further comprises a flexible material selected from the group consisting of nylon, PVC, canvas, latex or natural rubber, Gore-Tex™, vinyl, fluoropolymer fabrics, or other suitable synthetic materials and/or fabrics.

3. The water hydrant flushing device of claim 1, wherein the chute is of a longitudinal dimension sufficiently large to provide dissipation of kinetic energy in water discharged from a water hydrant.

4. The water hydrant flushing device of claim 1, wherein the first end further comprises a securing means.

5. The water hydrant flushing device of claim 1, where the first end further comprises a securing means, and wherein the securing means is selected from the group consisting of: a zipper, Velcro™ strips, snaps, cleats, laces, ties and hooks.

6. The water hydrant flushing device of claim 1, wherein the device further comprises at least one handle disposed on the chute.

7. The water hydrant flushing device of claim 1, wherein the at least one aperture is disposed at the first opening.

8. The water hydrant flushing device of claim 1, wherein the at least one aperture is disposed at the first opening, and wherein the at least one aperture comprises a hardware component selected from the group consisting of: a tube, a pipe, a cone, an elbow and a valve.

9. The water hydrant flushing device of claim 1, wherein the device comprises a pocket disposed on the chute, wherein the pocket accommodates at least one de-chlorination puck.

10. The water hydrant flushing device of claim 1, wherein the device comprises a pocket disposed on the chute, wherein the pocket accommodates at least one de-chlorination puck, and wherein the pocket comprises a transparent window.

11. The water hydrant flushing device of claim 1, wherein the at least one aperture is disposed at the first opening, and wherein the at least one aperture comprises a hollow tube of a length in the range of 3" to 36".

12. The water hydrant flushing device of claim 1, wherein the at least one aperture is disposed at the first opening, and wherein the at least one aperture comprises a hollow tube of a diameter in the range of 0.25" to 4".

13. A method for flushing a water hydrant, said method comprising the steps of: attaching the device of claim 1 to a water hydrant diffuser; and actuating a water flow valve on the water hydrant.

* * * * *